US005118341A

United States Patent [19]

Daver et al.

[11] Patent Number: 5,118,341

[45] Date of Patent: Jun. 2, 1992

[54] MACHINABLE POWDER METALLURGICAL PARTS AND METHOD

[75] Inventors: Edul M. Daver, Warren; Krishnakant B. Patel, Piscataway, both of N.J.

[73] Assignee: Alcan Aluminum Corporation, Cleveland, Ohio

[21] Appl. No.: 676,747

[22] Filed: Mar. 28, 1991

[51] Int. Cl.[5] ..... G22C 29/00

[52] U.S. Cl. ..... 75/231; 75/252; 419/10; 419/11; 419/12; 419/28; 419/32; 419/38

[58] Field of Search ..... 75/231, 252; 419/10, 419/11, 32, 38, 28, 12

[56] References Cited

U.S. PATENT DOCUMENTS

| | | | |
|---|---|---|---|
| 1,764,571 | 6/1930 | Lytle | 420/476 |
| 2,255,204 | 9/1941 | Best | 75/252 |
| 2,267,301 | 9/1941 | Dean | 420/482 |
| 2,368,943 | 2/1945 | Patterson | 75/22 |
| 2,373,158 | 4/1945 | Wulff | 75/5 |
| 3,253,910 | 5/1966 | Burghoff et al. | 75/135 |
| 3,622,302 | 11/1971 | Hayashi et al. | 75/58 |
| 3,795,493 | 3/1974 | Mertl | 29/182.5 |
| 3,846,186 | 11/1974 | Tipnis | 178/57 |
| 4,106,932 | 8/1978 | Blackford | 75/252 |
| 4,113,474 | 9/1978 | Okano | 75/156.5 |
| 4,249,945 | 2/1981 | Haswell et al. | 75/241 |
| 4,286,987 | 2/1981 | Matthews | 75/252 |
| 4,540,437 | 9/1985 | Patel | 75/251 |
| 4,542,048 | 9/1985 | Nickola et al. | 427/380 |
| 4,656,003 | 4/1987 | Miyafuji et al. | 460/473 |
| 4,851,191 | 7/1989 | Lee et al. | 420/471 |
| 4,971,255 | 11/1990 | Kawano et al. | 73/252 |
| 4,999,336 | 3/1991 | Nadkami et al. | 75/252 |

OTHER PUBLICATIONS

Elkem Metals, "High-Purity Manganese Sulfide MNS-230".

Pyron, "Metallurgical Data", Nov. 12, 1984.

*Primary Examiner*—Stephen J. Lechert, Jr.

*Attorney, Agent, or Firm*—Cooper & Dunham

[57] ABSTRACT

The invention provides a sinterable brass powder blend, comprising about 90% to about 99% by weight of brass powder, about 0.2% to about 6.0% by weight manganese sulfide, and 0% to about 5.0% by weight of lubricants, binders, graphite, sintering enhancing additives and mixtures thereof.

The invention also provides methods for making lead-free but machinable sintered brass powder metal parts.

23 Claims, 3 Drawing Sheets

MACHINABLE POWDER METALLURGICAL PARTS AND METHOD

TECHNICAL FIELD OF THE INVENTION

The present invention relates to improved sinterable copper and copper alloy powder metallurgical blends, and more particularly to sinterable brass powder metallurgical blends having added manganese sulfide to improve machinability.

BACKGROUND OF THE INVENTION

Powder metallurgy provides a useful and versatile technique for making non-ferrous metal parts, particularly those having an irregular shape. Briefly, powder metallurgy involves forming in a die having the precise shape of the desired part, compacting the selected non-ferrous metal or metal alloy powder, usually copper, brass or bronze, and then sintering the compacted part at an elevated temperature under a gaseous atmosphere which protects the part from oxidation during the extreme heat of the sintering process.

Although the parts so made conform closely to the shape of the die, they very often require further machining to obtain the desired dimensions and surface finish. In addition, many structural metal parts made by powder metallurgy undergo drilling, tapping, boring and sinking operations for attachment of fasteners and other parts. Thus, even though powder metallurgy can significantly reduce the amount of machining and cutting which a part must undergo, machinability remains an important property of sintered powder metallurgical parts.

Machinability in this context may be understood as the relative ease with which a portion of a part may be removed under specific cutting conditions, for example by drilling. Machinability of a metal part depends upon many factors, such as density, grain and pore size, alloy or metal composition, and microstructure of the sintered metal compact. Of these factors, chemical composition seems to most affect the machinability of the workpiece.

In the past, wrought and powder metallurgical products have been made more machinable by adding lead, tellurium and sulfur to the liquid copper, brass or bronze metal from which the metal powder will be formed. For example, C14500 tellurium cooper contains 0.50% tellurium, while C14700 sulfur copper contains 0.35% sulfur; such additives provide improved machinability. C33500, C34000 and C34200 designate low, medium and high lead content brasses (containing 0.5%, 1% and 2% lead respectively).

The use of lead as an additive in brass parts, however, has recently become viewed as undesirable. When atomizing the molten metal alloy, lead vapors may contaminate the air, and lead can be absorbed by workers handling lead powders during parts fabrication. High blood levels of lead have been implicated in a variety of health maladies, and the leaded content of products should be reduced or eliminated where possible.

Therefore, a need exists for a brass alloy having no lead content, but nevertheless having good machinability characteristics. Various additives for brass powders have been tried for different purposes, with varying results. For example, U.S. Pat. No. 4,656,002 (Miyafuji) discusses adding in excess of 0.001 wt % magnesium to a copper alloy to form a eutectic compound in the presence of sulfur. The resulting alloy is said to have increased hot working properties.

In U.S. Pat. No. 4,851,191, the patentees state that they improve copper alloys intended for high speed and heavy load applications by forming a fine grain Mn-Si precipitate with added tin and boron.

None of the foregoing additives seems suited to improving the machinability of copper alloys such as brass. Therefore, a principal object of the present invention is to provide a sinterable copper alloy having improved machinability characteristics.

SUMMARY OF THE INVENTION

The disadvantages of lead containing brass, or copper alloy parts are overcome and the foregoing and other objects are achieved by providing a sinterable copper or copper alloy powder blend comprising about 90% to about 99.8% by weight of brass powder, about 0.2% to about 6.0% by weight manganese sulfide, and about 0% to about 2.0% by weight of lubricant.

As another important aspect, the present invention provides a method for producing a sinterable brass blend comprising blending a brass powder with about 0.2 to about 6.0% by weight manganese sulfide and about 0% to about 2% by weight of lubricants.

A further aspect of the present invention involves a method of producing a machinable brass article comprising blending about 90% to about 99.8% by weight of brass powder, about 0.2% to about 6.0% by weight manganese sulfide, and about 0% to about 5.0% by weight of a material selected from lubricants, binders, graphite, sintering enhancing additives and mixtures thereof to form a brass powder blend, compacting the brass powder blend to form a brass powder compact, and sintering the compact in a nonoxidizing atmosphere at a temperature between about 1400° F. and 1800° F. to form a machinable brass article.

Yet another important aspect of the present invention includes a method for producing a sintered brass article, comprising blending about 90% to about 99.8% by weight of brass powder, about 0% to about 6.0% by weight manganese sulfide, and about 0% to about 5.0% by weight of a material selected from lubricant binders, graphite, sintering enhancing additives and mixtures thereof to form a sinterable brass powder blend, compacting the brass powder blend to form a coherent compact, sintering the compact in a nonoxidizing atmosphere at a temperature between about 1400° F. and 1800° F., and machining the article in a predetermined manner, for example, to obtain desired size and enhance surface finish or provide apertures for attachment of fasteners.

A still further important aspect of the present invention provides a method for producing a sintered brass article having improved machinability. The method comprises blending about 90% to about 99.8% by weight of brass powder, about 0% to about 6.0% by weight manganese sulfide, and about 0% to about 5.0% by weight of a material selected from the group consisting of lubricants, binders, graphite, sintering enhancing additives and mixtures thereof to form a brass powder blend, compacting the brass powder blend to form a coherent compact, and sintering the compact in a nonoxidizing atmosphere at a temperature between about 1400° F. and 1800° F., wherein the article has improved machinability and is substantially free from lead.

BRIEF DESCRIPTION OF THE DRAWINGS

Other features, advantages and aspects of the invention may be understood by reviewing the attached detailed description of the preferred embodiments in conjunction with the accompanying drawings, in which.

DETAILED DESCRIPTION OF THE PREFERRED EMBODIMENTS

Figure 1:
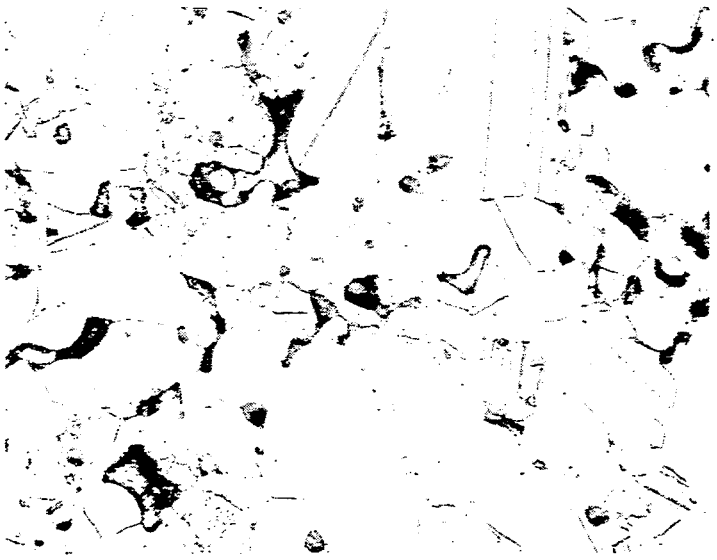
FIG. 1 is a photomicrograph taken at 500× of a sintered brass powder compact without added manganese sulfide.

Percentages expressed herein are weight percentages and temperature are expressed in degrees Fahrenheit, unless otherwise specified.

Powder metallurgy involves compacting suitable metal powders into a precisely dimensioned die and sintering the compacted part at an elevated temperature in a sintering furnace under an atmosphere of protective gas. Sintering provides metallurgical strength. The die cavity imparts the desired size and shape to the part and thereby reduces the required machining of the part.

The present invention in a broad sense applies to powder metallurgical parts made from copper, or a copper based alloy such as brass, bronze, or Nickel Silver (Cu—Ni—Zn), although the invention has particular application to machinable brass powder metallurgical parts. The copper or copper based alloy powder is blended with an amount of manganese sulfide effective to improve the machinability of the powder blend.

Brass powder is widely used to fabricate powder metallurgical parts such as latch bolts, lock cylinders, gears, cams, and drive assemblies. Brass powder for use in the present invention can be any conventional brass powder useful in sintering brass metal powder parts. For example, brass powders having compositions containing from 50% to 95% copper and from 5% to 50% zinc in alloy form are well suited for use in the present invention. The ratio of copper to zinc can be varied in accordance with the desired final product, and typically includes additives such as lubricants and sintering enhancing additives. Brass powder is normally produced by melting commercial purity scrap copper, which is typically 99% or higher pure copper, but contains other impurities such as iron, aluminum, silicon, lead, bismuth, etc. The copper scrap or primary ingot or cathode copper is melted in a conventional furnace such as gas fired crucible and/or reverberatory, induction or channel-type electric furnaces or resistance furnaces. After melting the copper charge to the desired temperature (approximately 2050° F.), the requisite amount of commercially pure zinc (99.9% Zn) is added to the molten copper as zinc slabs. Commercially pure zinc typically contains impurities such as iron, lead and cadmium. Since zinc vaporizes at 1665° F., one can expect to lose some of the zinc as vapor when it is added to the liquid copper. By constantly monitoring the liquid metal temperature, one can minimize zinc loss, but an excess of zinc should be added in making the liquid brass so that the resulting brass powder has the desired composition.

Once the desired brass composition and temperature is obtained, the liquid brass may be atomized with compressed air, nitrogen or with water at high pressure to disintegrate the molten metal into small particles. The powder particles, when cooled, are screened over U.S. mesh size 20, 60, 80, 100, 150, or 325 as desired. The powder passing through the screen is collected by size in drums. Oversized powder (i.e. powder retained on the screen) may be remelted. The powder may be blended into double cone or v-shaped blenders for a period ranging from 5 to 60 minutes.

The brass powders blended in accordance with the present invention usually but optionally include a lubricant, binder, graphite, a sintering enhancing additive or a mixture thereof, which may be added while the powder is being blended. Lubricants, binders, graphite and sintering enhancing additives such as Sn, P, Ni, Zn or B, or mixtures of the foregoing should preferably be added in an amount ranging from 0% to 5% by weight, with about 0.2 to 2% by weight being preferred. Conventional lubricants include lithium stearate, zinc stearate, and stearic acid, among others. The preferred lubricants for brass, however, are lithium and zinc stearates added in combination. Preferably the amount of lubricant should be between about 0.5% and 1.0% by weight of the brass powder blend.

Advantageously, manganese sulfide (MnS) should be added to the blender either before or after adding lubricants and other additives. Alternatively, concentrated mix comprising a small amount of brass powder and all of the additives including lubricants and manganese sulfide may be sifted through a coarse screen and blended in a small blender. The concentrated mix may be added to a large blender where the remaining quantity of brass powder is added. The amount of MnS added to the blend depends on the brass part being fabricated and the amount of machining which it must undergo. A preferable range of MnS is from 0.2% to about 6%, although from 0.25% to about 2.0% is presently preferred, with about 0.6% to about 0.8% by weight MnS being most preferred. A higher level of MnS increases the machinability of the sintered compact, but may affect the sintered strength appreciably. The sintering enhancing additives discussed above enhance sintering and are expected to provide greater sintered strength. Manganese sulfide for use in the present invention may be obtained as Manganese Sulfide Powder from Elkem Corporation, Pittsburgh, Pa.

The blended powder is now ready for compaction on a press. The powder is evenly spread into a machine die cavity which resembles the shape of the part. The press compacts powder at a pressure ranging from about 5 tons to about 50 tons per square inch, with about 20–40 tons per square inch being preferred. The compacted parts are passed through a sintering furnace preheated to a temperature ranging from about 1400° F. to about 1800° F., more typically in the range of 1600° F. to 1700° F. The furnace contains a nonoxidizing or reducing gas atmosphere such as a mixture of hydrogen and nitrogen or dissociated ammonia which protects the powder metallurgy parts against oxidation. The sintered parts, after completion of the sintering cycle, pass through a cooling section and are ready for further processing. The parts may undergo such operations as sizing, tumbling, deburring, heat treatment, and machining. Machining operations typically include drilling, tapping, turning, undercut, counterboring, countersinking, and facing, and may be performed as needed to finish the part.

Addition of MnS into brass powder has resulted in significant improvement in the machining characteristics of brass powder metallurgy parts. Without being bound by theory, it is believed that during compaction the MnS particles occupy voids between the brass particles and are essentially unaffected by sintering. The soft and malleable MnS particles fill most of the pores and provide dry lubrication on the surface of a cutting tool during any machining operations which follow sintering. This lubrication prolongs the life of the cutting tool significantly. The use of conventional lubricants is insufficient in machining sintered brass powder parts, and brass powder without lead requires an alternative machining additive to make brass powder metallurgy a practical method for making machinable brass parts.

The following Examples are set forth to aid in the understanding of the invention and to illustrate its practice. The Examples are not intended to, and should not be construed to limit the invention as set forth in the claims.

EXAMPLE 1

8020 brass alloy was produced by melting commercial purity copper (99.5% minimum), and zinc (99.9% purity) into an induction furnace. Liquid metal approximately 80% copper and 20% zinc in content was stirred to homogenize, and then atomized at 2100°-2200° F. using high pressure air and metal atomization equipment. The resulting brass powder, when cool, was screened through 100 U.S. mesh, and the product passing through this screen was collected into drums. Brass powder contained in the drums was then blended for 30 minutes to obtain an even particle size distribution. Small batches of brass powder blends (100-175 lb.) were then prepared by blending a fixed proportion of lubricants and varying amounts of MnS as shown in Table I below.

TABLE I

SINTERABLE BRASS POWDER MIXTURES

| Blend No. | Wt. of 8020 Brass in lbs. | Lubricant Addition: Lithium Stearate lbs. | Lithium Stearate % | Zinc Stearate lbs. | Zinc Stearate % | Manganese Sulfide Addition lbs. | Manganese Sulfide Addition % |
|---|---|---|---|---|---|---|---|
| 1 | 100.0 | 0.25 | 0.25 | 0.25 | 0.25 | 0.0 | 0.0 |
| 2 | 124.7 | 0.31 | 0.25 | 0.31 | 0.25 | 0.31 | 0.25 |
| 3 | 174.1 | 0.44 | 0.25 | 0.44 | 0.25 | 0.87 | 0.50 |
| 4 | 198.5 | 0.50 | 0.25 | 0.50 | 0.25 | 1.50 | 0.75 |

Table I states the composition of four 8020 brass powder mixtures containing varying amounts of manganese sulfide and fixed amounts of zinc and lithium stearates as lubricants. A sample of each of the brass powder blends was compacted at a pressure of 25 tons per square inch into 4.0 inch diameter slugs having a height of 1.0 inch, and a density of 7.20±0.05 grams per cubic centimeter. Each slug weighed approximately 3.27 lbs. Table II below indicates the number of slugs compacted for each of mixtures 1 through 4 set forth in Table I.

TABLE II

| Mixture No. | No. Slugs |
|---|---|
| 1 | 10 |
| 2 | 25 |
| 3 | 40 |
| 4 | 40 |

Figure 2:
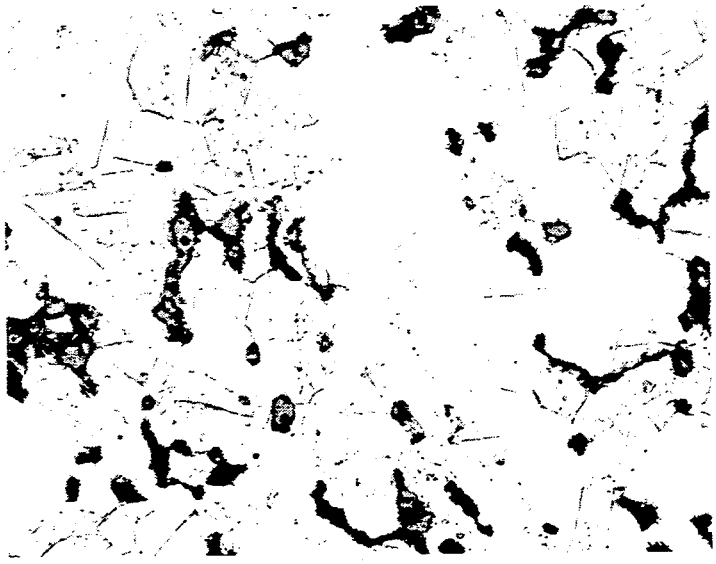
FIG. 2 is a photomicrograph of a sintered brass powder compact containing manganese sulfide in accordance with the present invention.

The slugs were then sintered in a commercial sintering furnace set at preheat of 1620° F. and high heat temperatures of 1660° F. under a reducing gas atmosphere made up of 3.4 Vol % hydrogen and 96.6 Vol % nitrogen. The belt speed of the sintering furnace was adjusted so that the slugs remained 7 minutes in the preheat section and 38 minutes in the high heat section of the sintering furnace. Once cooled, the slugs were measured for various physical properties. Measurements of diameters made before and after sintering revealed an average approximate shrinkage of 1.5% for all of the samples measured, regardless of mixture. FIG. 1 is a photomicrograph of a sintered brass powder compact lacking manganese sulfide. FIG. 2 is a photomicrograph of a sintered brass powder compact including manganese sulfide as an additive. The manganese sulfide appears in the dark black pore network as light gray islands. The average sintered density of five sample pieces from each mixes 1 through 4 was calculated as set forth in Table III.

TABLE III

| Mix No. | Density (g/cc) |
|---|---|
| 1 | 7.48 |
| 2 | 7.53 |
| 3 | 7.57 |
| 4 | 7.54 |

To determine the effect, if any, of MnS on machinability of the brass powder sintered compact, sintered slugs samples of all four mixes were then machined at a commercial machine shop. A determination of relative machinability of the various brass powder mixtures was made by determining the maximum number of holes which could be drilled in a sample until the drill bit failed. A No. 28 drill bit was used at a speed of 1500 revolutions per minute and a feed rate of 18.6 inches per minute. The holes were drilled on the flat surface using a CNC programmable drilling machine without the use of a coolant. Each hole was made approximately 0.5 inch deep. The distance between adjacent holes was determined to drill a maximum of 175 holes on each side of the slug. Each drill bit was used until it could no longer drill any more holes in the slugs. The total number of holes drilled by each drill bit was then recorded. All batches of slugs were tested in this manner.

In order to compare the relative performance of each mix, the following machinability index can be determined:

$$Mx = \frac{Hx \text{ (No. of holes drilled in samples containing } X\% \text{ } Mns)}{Hn \text{ (No. of holes drilled in samples not containing } MnS)}$$

Table IV indicates maximum number of holes per drill bit for each of mixes 1 through 4.

TABLE IV

MACHINABILITY TEST DATA FOR 4 INCH DIA. P/M BRASS SLUGS

| Mix. No. | Wt. % MnS Contained in brass powder | # of holes per drill bit | Machinability Index - Mx |
|---|---|---|---|
| 1 | 0.0 | 27 | 1.00[1] |
| 2 | 0.25 | 103 | 3.80 |

TABLE IV-continued

MACHINABILITY TEST DATA FOR 4 INCH DIA. P/M BRASS SLUGS

| Mix. No. | Wt. % MnS Contained in brass powder | # of holes per drill bit | Machinability Index - Mx |
|---|---|---|---|
| 3 | 0.50 | 113 | 4.20 |
| 4 | 0.75 | 142 | 5.25 |

[1]Mix No. 1 (containing 0% MnS) is a control or reference material. Its Mx is set at 1.00.

The data in Table IV demonstrate a significant increase in the number of drilled holes for powder metallurgy brass slugs containing MnS. Also, as the content of MnS increased from 0.25% to 0.75%, the machinability index of the slugs improved from 3.80 to 5.25. Without the use of MnS, only a very small number (27) of holes could be drilled into the brass compact, whereas approximately five times as many could be drilled into the compacts made from brass admixed with 0.75% MnS.

In addition, filings emerged from the holes more easily in slugs containing MnS, as compared to the slugs not containing MnS. Moreover, visual inspection demonstrated that the surface finish of the drilled surface of brass slugs containing MnS was superior than that of slugs not containing any MnS.

EXAMPLE II

Figure 3:
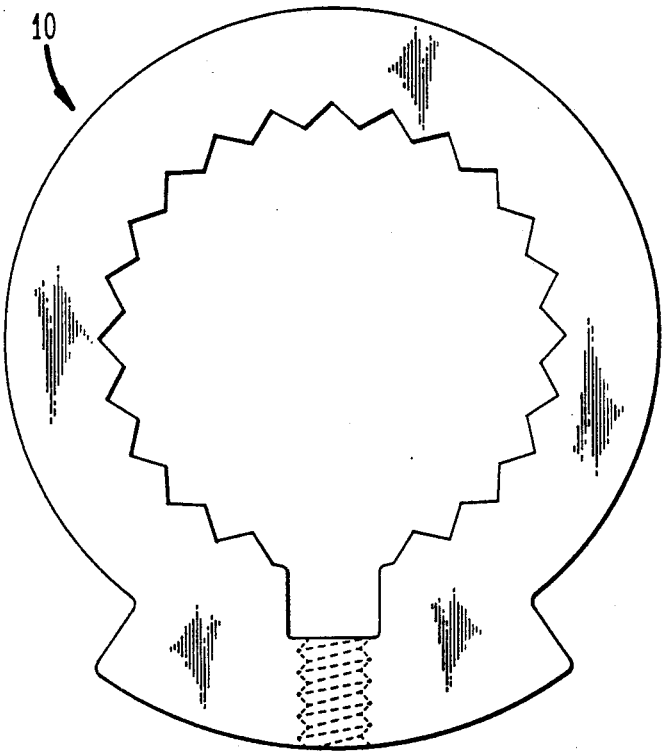
FIG. 3 is a schematic drawing of a sintered powder metallurgical brass splined stop collar made from the improved brass powder in accordance with the improved process of the present invention.
Figure 4:
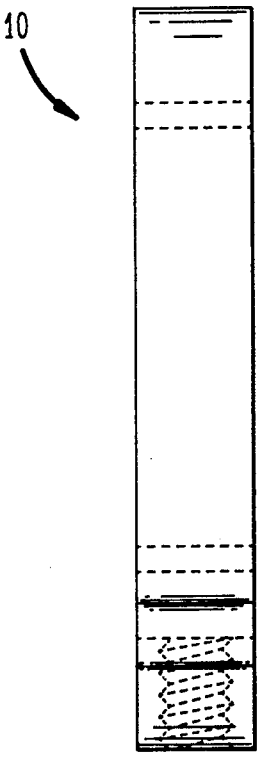
FIG. 4 is a side view of the splined stop collar of FIG. 3.

Using the same 8020 brass powder as a base material and the same preparation method outlined in Example I, two additional 75 lb. mixtures, each containing 0.25% and 0.50% MnS, were prepared. Mixture No. 5 contained 0.25% MnS and mixture No. 6 contained 0.50% MnS. These mixes were used to press a ring shaped part as shown in FIGS. 3 and 4 and known as a splined stop collar 10. Each part weighed 16.3 gms. before machining. Parts were pressed at 25.0 tons per square inch pressure to a density of 7.2 grams per cubic centimeter. Since only one hole would be drilled per piece, approximately 1700 parts were pressed from each of mixtures 5 and 6. These sample pieces were sintered in the same commercial sintering furnace as used in Example I. The preheat section was maintained at 1660° F. and high heat section was maintained at 1710° F. The same reducing gas mixture was used as in Example I.

The belt speed of the sintering furnace was adjusted in order to provide a total of 40 minutes in preheat and high heat sections. Cooled parts were collected and checked for dimensions, and inspected visually. The sintered density for these pieces was 7.8 grams per cubic centimeter. Each piece had a hole 0.3 inch deep drilled in it, and then tapped. The parts were tested on a drilling machine using 0.188 inch step drill bit. The drill bit turned at 2800 revolutions per minute, with occasional application of a liquid coolant. All pieces were tapped using 0.25 inch UNC3B tap rotating at 900 revolutions per minute. Table V gives the test data.

TABLE V

MACHINING TESTS FOR LOCKING RING

| Mix No. | Wt. % MnS contained in Brass Powder | Number of drill bits required to complete drilling 1700 pieces of locking rings | Number of taps req'd. to thread holes for 1700 pieces of locking rings | Progressive No. of holes drilled with each drill bit |
|---|---|---|---|---|
| 5 | 0.25 | 4 | 1 | 1st - 405<br>2nd - 765<br>3rd - 1165<br>4th - Did not fail before 1700 |
| 6 | 0.50 | 2 | 1 | 1st - 654<br>2nd - 1710 |

The data in Table V indicate that higher amounts of MnS give impressive and noticeable improvements in machinability, as measured by the drill bit life experiments. Compaction of plain brass powder (without added MnS) into splined stop collar rings was not performed in this example because the tests in Example I demonstrate its lack of machinability.

What is claimed is:

1. A sinterable brass powder blend, comprising:

about 90% to about 99.8% by weight of brass powder;

about 0.2% to about 6.0% by weight manganese sulfide; and

0% to about 5.0% by weight of a lubricants, binders, graphite, sintering enhancing additives and mixtures thereof.

2. A sinterable brass powder blend in accordance with claim 1, wherein the brass powder comprises from about 50% to about 95% copper and from about 5% to about 50% of zinc.

3. A sinterable brass powder blend in accordance with claim 2 wherein said brass powder is screened through mesh size from about 20 to about 325 U.S. mesh.

4. A sinterable brass powder blend in accordance with claim 2 wherein the brass powder consists essentially of about 80% copper and about 20% zinc with normal impurities.

5. A sinterable brass powder blend in accordance with claim 2 wherein said blend contains from about 0.25% by weight to about 2.0% by weight manganese sulfide.

6. A sinterable brass powder in accordance with claim 5 containing about 0.6% to 0.8% by weight manganese sulfide.

7. A method for producing a sinterable brass powder blend comprising:

blending a brass powder with about 0.2% to about 2.0% by weight manganese sulfide and about 0% to about 2% by weight of lubricants.

8. A method in accordance with claim 7, wherein the brass powder is blended with about 0.25 to about 2.00% by weight manganese sulfide.

9. A method in accordance with claim 8 wherein the brass powder is blended with about 0.6% to about 0.8% by weight manganese sulfide.

10. A method of producing a machinable brass article comprising:

blending about 90% to about 99.8% by weight of brass powder, about 0.2 to about 6.0% by weight manganese sulfide and about 0% to about 5.0% by weight of a material selected from the group consisting of lubricants, binders, graphite, sintering enhancing additives and mixtures thereof to form a brass powder blend;

compacting the brass powder blend to form a compact; and sintering the compact in a nonoxidizing atmosphere at a temperature between about 1400° F. and 1800° F. to form a machinable brass article.

11. A method in accordance with claim 10 wherein the brass powder is blended with about 0.6% to about 0.8% by weight manganese sulfide.

12. A method for producing a sintered brass article, comprising:

blending about 90% to about 99.8% by weight of brass powder, about 0.2% to about 5.0% by weight manganese sulfide, and about 0% to about 5.0% by weight of a material selected from the group consisting of lubricants, binders, graphite, sintering enhancing additives and mixtures thereof to form a sinterable brass powder blend;

compacting the blend to form a coherent compact and sintering the compact in a nonoxidizing atmosphere at a temperature between about 1400° F. and 1800° F.; and machining the article in a predetermined manner.

13. A method in accordance with claim 12, wherein the brass powder is blended with about 0.25 to about 2.00% by weight manganese sulfide.

14. A method in accordance with claim 12 wherein the brass powder is blended with about 0.6% to about 0.8% by weight manganese sulfide.

15. A method for producing a sintered brass article having improved machinability, comprising:

blending about 90% to about 99.8% by weight of brass powder, about 0.2 to about 6.0% by weight manganese sulfide, and about 0% to about 5.0% by weight of a material selected from the group consisting of lubricants, binders, graphite, sintering enhancing additives and mixtures thereof to form a brass powder blend;

compacting the brass powder blend to form a coherent compact; and sintering the compact in a reducing atmosphere at a temperature between about 1400° F. and 1800° F., wherein the article has improved machinability and is substantially free from lead.

16. A method in accordance with claim 15 wherein the amount of manganese sulfide ranges from about 0.5% to about 0.8% by weight of the brass powder blend.

17. A product made in accordance with the method of claim 10.

18. A product made in accordance with the method of claim 12.

19. A product made in accordance with the method of claim 15.

20. A product made in accordance with the method of claim 16.

21. A method for making a sintered powder metallurgical copper or copper based alloy compact having improved machinability, comprising:

blending a copper or copper based alloy metal powder with an amount of manganese sulfide effective to improve the machinability of the copper or copper based alloy to form a copper or copper based alloy blend;

compacting the blended copper alloy powder to form a compact;

sintering the compact in a nonoxidizing atmosphere at a temperature between about 1400° F. to about 1800° C. to form a machinable copper alloy article.

22. A method in accordance with claim 21, wherein the copper based alloy is a brass alloy.

23. A method in accordance with claim 22 wherein the effective amount of manganese sulfide ranges from about 0.2% by weight to about 6.0% by weight, and the method additionally comprises adding a sintering enhancing additive selected from the group consisting of Sn, P, Ni, Zn and B to said copper based alloy or said blend prior to sintering.

* * * * *